US009617500B2

(12) United States Patent
Graf et al.

(10) Patent No.: US 9,617,500 B2
(45) Date of Patent: Apr. 11, 2017

(54) DETERGENT COMPOSITION WITH IMPROVED DRYING PERFORMANCE

(71) Applicant: RECKITT BENCKISER N.V., Hoofddorp (NL)

(72) Inventors: Nicole Graf, Ludwigshafen (DE); Steffen Lingler, Ludwigshafen (DE)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 0 days.

(21) Appl. No.: 14/880,547

(22) Filed: Oct. 12, 2015

(65) Prior Publication Data

US 2016/0264912 A1 Sep. 15, 2016

Related U.S. Application Data

(63) Continuation of application No. 14/005,270, filed as application No. PCT/GB2012/050523 on Mar. 9, 2012, now Pat. No. 9,157,050.

(30) Foreign Application Priority Data

Mar. 14, 2011 (GB) ..... 1104244.7

(51) Int. Cl.

| | |
|---|---|
| ***C11D 1/825*** | (2006.01) |
| ***C11D 1/88*** | (2006.01) |
| ***C11D 3/37*** | (2006.01) |
| ***B08B 3/04*** | (2006.01) |
| ***C11D 1/72*** | (2006.01) |
| ***C11D 1/94*** | (2006.01) |
| ***C11D 1/90*** | (2006.01) |
| ***C11D 11/00*** | (2006.01) |

(52) U.S. Cl.

CPC ..... *C11D 1/72* (2013.01); *C11D 1/721* (2013.01); *C11D 1/825* (2013.01); *C11D 1/90* (2013.01); *C11D 1/94* (2013.01); *C11D 11/0023* (2013.01)

(58) Field of Classification Search

CPC ..... C11D 1/721; C11D 1/825; C11D 1/88; C11D 3/37; C11D 3/3796; C11D 3/3757; B08B 3/04

See application file for complete search history.

(56) References Cited

U.S. PATENT DOCUMENTS

| | | | | |
|---|---|---|---|---|
| 5,308,532 A | 5/1994 | Adler et al. | | |
| 5,977,053 A | 11/1999 | Groth et al. | | |
| 9,157,050 B2 * | 10/2015 | Graf | ..... | C11D 1/721 |
| 2002/0039980 A1 | 4/2002 | Yamamoto et al. | | |
| 2008/0045441 A1 * | 2/2008 | Schmiedel | ..... | C11D 1/721 510/514 |

FOREIGN PATENT DOCUMENTS

| | | | | | |
|---|---|---|---|---|---|
| DE | 19738866 | A1 | | 3/1999 | |
| EP | 1321509 | A1 | | 6/2003 | |
| EP | 1741774 | A1 | | 1/2007 | |
| EP | 1764408 | A1 | | 3/2007 | |
| WO | 9426859 | A1 | | 11/1994 | |
| WO | 9426860 | A1 | | 11/1994 | |
| WO | 9501416 | A1 | | 1/1995 | |
| WO | 9958633 | A1 | | 11/1999 | |
| WO | 2005090541 | A1 | | 9/2005 | |
| WO | 2009100855 | A2 | | 8/2009 | |
| WO | WO 2009/100855 | | * | 8/2009 | ..... C11D 1/825 |
| WO | 2010063690 | A1 | | 6/2010 | |
| WO | WO 2010/063690 | | * | 6/2010 | ..... C11D 1/72 |

OTHER PUBLICATIONS

International Search Report mailed Jul. 10, 2012 for priority application PCT/GB2012/050523.

* cited by examiner

*Primary Examiner* — Brian P Mruk

(74) *Attorney, Agent, or Firm* — Troutman Sanders LLP; Ryan Schneider; Chris Davis

(57) ABSTRACT

A detergent composition with a superior drying performance is provided comprising a surfactant according to the formula:

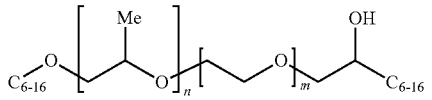

wherein n=0-5 and m=10-50;
or formula 2:

$R^1O(AlkO)xM(OAlk)yOR^2$ wherein $R^1$ and $R^2$ are independently saturated or unsaturated, and possibly hydroxylated, alkyl radicals with 4 to 22 carbon atoms.

wherein Alk is an alkyl radical with 2-4 carbon atoms;

wherein x and y are independently an integer between 1 and 70;

wherein M is an alkyl radical selected from the group $CH_2$, $CHR^3$, $CR^3R^4$, $CH_2CHR^3$, $CHR^3CHR^4$; and wherein $R^3$ and $R^4$ are independently saturated or unsaturated alkyl radicals with 1 to 18 carbon atoms.

11 Claims, No Drawings

DETERGENT COMPOSITION WITH IMPROVED DRYING PERFORMANCE

CROSS REFERENCE TO RELATED APPLICATIONS

This application is a Continuation Application of U.S. patent application Ser. No. 14/005,270, issued as U.S. Pat. No. 9,157,050, filed 31 Jan. 2014, which is a U.S. National Stage Entry of International Application No. PCT/GB2012/050523, filed 9 Mar. 2012, which claims the benefit of GB 1104244.7, filed 14 Mar. 2011, all of which are herein fully incorporated by reference as if set forth below.

BACKGROUND OF THE INVENTION

The present invention relates to detergent compositions for automatic dishwashing machines. In particular, automatic dishwashing detergent compositions that have superior drying performance.

Consumers demand that their detergent compositions provide many different benefits.

One desired feature of a detergent composition suitable for use in an automatic dishwasher is that the resulting wash liquor dries quickly and evenly.

Consumers do not like to find wet tableware after a wash cycle. Nor do they like finding streaks or residues on their cleaned and dried tableware.

Providing a detergent composition that dries efficiently and evenly is therefore desirable from an aesthetic standpoint.

There is also an environmental benefit. The more effectively the wash liquor dries, the shorter drying cycle that is required by the machines. Or lower temperatures may be utilised during the drying cycle. Thus improved drying performance saves both energy and money.

Drying performance is usually improved with the use of surfactants. However the presence of these surfactants can adversely effect the main wash/rinse performance of the formulation, or are lost in the main wash and not effective due to low concentration in the rinsing and drying stages.

Because of this, and to avoid using very high concentrations of surfactants, specialised surfactant containing compositions to improve drying are often added separately at the end of the wash cycle. These products are usually called rinse aids.

The need for a separate rinse product adds additional cost for the consumer and complexity for the designer of the machine.

Even with these rinse products a compromise usually has to be found between rinse performance and drying performance. Surfactants that are provide good rinse performance can often adversely effect drying performance and vice versa.

It has surprisingly been found by the applicant, a particular class of non-ionic surfactants that provides excellent drying performance without compromising rinse performance.

The excellent drying performance is particularly improved with respect to plastic materials, such as food storage pots.

DETAILED DESCRIPTION OF THE INVENTION

Embodiments of the present invention relate generally to detergent compositions for use in automatic dishwashing machines, particularly detergent compositions with superior drying performance. One skilled in the art will recognize, however, that the invention is not so limited.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction, arrangement of components, and methods of making set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Surfactants

In a first aspect of the present invention a detergent composition is provided with a superior drying performance comprising at least one non-ionic surfactant according to formula 1:

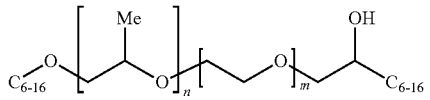

wherein n=0-5 and m=10-50;

or formula 2:

$$R^1O(AlkO)_xM(OAlk)_yOR^2$$

wherein $R^1$ and $R^2$ are independently branched or straight chain, saturated or unsaturated, and possibly hydroxylated, alkyl radicals with 4 to 22 carbon atoms;

wherein Alk is a branched or unbranched alkyl radical with 2-4 carbon atoms;

wherein x and y are independently an integer between 1 and 70; and wherein M is an alkyl radical selected from the group $CH_2$, $CHR^3$, $CR^3R^4$, $CH_2CHR^3$, $CHR^3CHR^4$, wherein $R^3$ and $R^4$ are independently a branched or straight chain saturated or unsaturated, alkyl radicals with 1 to 18 carbon atoms.

In a further aspect of the present invention the non ionic surfactant comprises Dehypon GRA™ manufactured by Cognis.

In a further aspect of the present invention the non ionic surfactant comprises Dehypon E127™ manufactured by Cognis.

In a further aspect of the present invention a detergent composition is provided with a superior drying performance comprising at least two different non-ionic polymers according to formula 1 or formula 2.

In a further aspect of the present invention the at least two non-ionic surfactants comprise Dehypon GRA™ and Dehypon E127™.

In a further aspect of the present invention the detergent composition may additionally comprise an amphoteric polymer.

In a further aspect of the present invention the amphoteric polymer has the general formula:

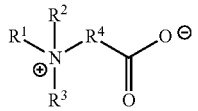

wherein $R^1$ is an alkyl group having 10 to 20 carbon atoms, preferably 12 to 16 carbon atoms or the amido radical:

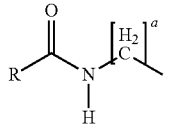

wherein R is an alkyl group having 9-19 carbon atoms and a in an integer between 1 and 4;

$R^2$ and $R^3$ are each alkyl groups having 1 to 3 carbons and preferably 1 carbon; and R4 is an alkylene or hydroxyalkylene group having from 1 to 4 carbon atoms and, optionally, one hydroxyl group.

Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl diemethyl betaine, cetyl dimethyl betaine and stearyl dimethyl betaine. The amidobetaines similarly include cocoamidoethylbetaine and cocoamidopropyl betaine. A preferred betaine is coco ($C_8$-$C_{18}$) amidopropyl dimethyl betaine.

In a further aspect of the present invention the amphoteric polymer is produced by Rhodia under the tradename Mirapol Surf S.

The applicant has surprisingly found that surfactants of the type in formula 1 or formula 2 provide improved drying performance in automatic dishwashing compositions while maintaining wash and rinse performance.

Thus rinse aid usage may be reduced or eliminated.

Preferably more than one surfactant, or at least two different surfactants from formula 1 or formula 2 are used in the detergent composition.

Each surfactant from formula 1 or formula 2 may be present from between 0.5 and 25% by weight of the detergent composition. Preferably each surfactant may be present between 1 and 15%, more preferably between 1.5 and 10% by weight and most preferably between 2% and 6% by weight of the detergent composition.

Highly effective but non limiting examples of effective surfactants described in formula 1 or formula 2 are Dehypon GRA™ and Dehypon E127™ which are supplied by Cognis.

Preferably the detergent composition additionally comprises an amphoteric surfactant.

Preferably the amphoteric surfactant is selected from the group comprising quaternized ammonium acrylamide/acrylic acid copolymers.

More preferably the amphoteric surfactant is selected from the general formula:

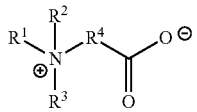

wherein $R^1$ is an alkyl group having 10 to 20 carbon atoms, preferably 12 to 16 carbon atoms or the amido radical:

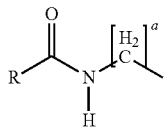

wherein R is an alkyl group having 9-19 carbon atoms and a in an integer between 1 and 4;

wherein $R^2$ and $R^3$ are each alkyl groups having 1 to 3 carbons and preferably 1 carbon; and wherein R4 is an alkylene or hydroxyalkylene group having from 1 to 4 carbon atoms and, optionally, one hydroxyl group.

More preferably the amphoteric surfactant is a diallyl dimethyl ammonium acrylamide/acrylic acid copolymer. A particularly preferred material is produced by Rhodia under the tradename Mirapol Surf S. A more preferred material is Mirapol Surf S powder.

Forms

The detergent compositions may take any form known in the art. Possible forms include tablets, powders, gels, pastes and liquids. The detergent compositions may also comprise a mixture of two or more forms. For example the composition may comprise a gel component and a free powder component. The particles of the present invention may be contained within the gel portion or the powder portion of the detergent composition, or contained within both portions.

Tablets may be homogeneous of composed of multi-layers. If the tablets are multi-layered then different layers may comprise different parts of the detergent composition. This may be done to increase stability or increase performance, or both. The particles of the present invention may be contained within one or more layers of the tablets.

The detergent compositions may be housed in PVOH rigid capsules or film blisters. These PVOH capsules or blisters may have a single compartment or may be multi-compartment.

Multi-compartment blisters or capsules may have different portions of the composition in each compartment, or the same composition in each compartment. The distinct regions/or compartments may contain any proportion of the total amount of ingredients as desired.

The PVOH capsules or film blisters may be filled with tablets, powders, gels, pastes or liquids, or combinations of these.

Builders

The detergent compositions may comprise any ingredients known in the art. These may include components such as builders, The builder may be either a phosphorous-containing builder or a phosphorous-free builder as desired.

If phosphorous-containing builders are also to be used it is preferred that mono-phosphates, di-phosphates, tri-polyphosphates or oligomeric-poylphosphates are used. The alkali metal salts of these compounds are preferred, in particular the sodium salts. An especially preferred builder is sodium tripolyphosphate (STPP). Conventional amounts of the phosphorous-containing builders may be used typically in the range of from 15% by weight to 60% by weight, such as from 20% by weight to 50% by weight or from 25% by weight to 40% by weight.

If a phosphorous-free builder is included it is preferably chosen from amino acid based compounds and/or succinate based compounds. The terms 'succinate based compound' and 'succinic acid based compound' are used interchangeably herein. Conventional amounts of the amino acid based compound and/or succinate based compound may be used typically in the range of from 05% by weight to 80% by weight, such as from 15% by weight to 70% by weight or from 20% by weight to 60% by weight.

Preferred examples of amino acid based compounds which may be used are MGDA (methyl-glycine-diacetic acid, and salts and derivatives thereof) and GLDA (glutamic-N,N-diacetic acid and salts and derivatives thereof). Other suitable builders are described in U.S. Pat. No. 6,426,229 which are incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N, N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula:

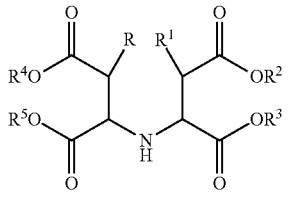

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6 R^7 R^8 R^9 N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms.

Preferred examples include tetrasodium imminosuccinate Iminodisuccinic acid (IDS) and (hydroxy)iminodisuccinic acid (HIDS) and alkali metal salts or ammonium salts thereof are especially preferred succinate based builder salts.

It is especially preferred according to the present invention that the builder comprises methyl-glycine-diacetic acid, glutamic-N,N-diacetic acid, tetrasodium imminosuccinate, or (hydroxy)iminodisuccinic acid and salts or derivatives thereof.

The phosphorous-free builder may also or alternatively comprise non-polymeric organic molecules with carboxylic group(s). Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred phosphorous-free builder is sodium citrate. Such polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Such polycarboxylates which contain three carboxyl groups include, for example, water-soluble citrate. Correspondingly, a suitable hydroxycarboxylic acid is, for example, citric acid.

Preferably the total amount of builder present is an amount of at least 20% by weight, and most preferably at least 25% by weight, preferably in an amount of up to 70% by weight, preferably up to 65% by weight, more preferably up to 60% by weight. The actual amount used in the compositions will depend upon the nature of the builder used. If desired a combination of phosphorous-containing and phosphorous-free builders may be used.

The detergent compositions may optionally further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the above-mentioned compounds are the ammonium and/or alkali metal salts, i.e. the lithium, sodium, and potassium salts, and particularly preferred salts is the sodium salts. Secondary builders which are organic are preferred. A polymeric polycarboxylic acid is the homopolymer of acrylic acid. Other suitable secondary builders are disclosed in WO 95/01416, to the contents of which express reference is hereby made.

Preferably the total amount of co-builder present is an amount of up to 10% by weight, preferably at least 5% by weight. The actual amount used in the compositions will depend upon the nature of the builder used.

Buffering Systems

The detergent compositions may also comprise a source of acidity or a source of alkalinity, to obtain the desired pH, on dissolution, especially if the composition is to be used in an automatic dishwashing application. Preferred silicates are sodium silicates such as sodium disilicate, sodium metasilicate and crystalline phyllosilicates. A source of acidity may suitably be any suitable acidic compound for example a polycarboxylic acid. For example a source of alkalinity may be a carbonate or bicarbonate (such as the alkali metal or alkaline earth metal salts). A source of alkalinity may suitably be any suitable basic compound for example any salt of a strong base and a weak acid. When an alkaline composition is desired silicates are amongst the suitable sources of alkalinity.

Anti-corrosion Agents

The detergent compositions may comprise one or more anti-corrosion agents, especially when the detergent compositions are for use in automatic dishwashing operations.

These anti-corrosion agents may provide benefits against corrosion of glass and/or metal and the term encompasses agents that are intended to prevent or reduce the tarnishing of non-ferrous metals, in particular of silver and copper.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, bismuth, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, Zinc acetate, zinc sulphate and $Ce(NO_3)_3$. Any suitable source of multivalent ions may be used, with the source preferably being chosen from sulphates, carbonates, acetates, gluconates and metal-protein compounds. Zinc salts are specially preferred corrosion inhibitors.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Any conventional amount of the anti-corrosion agents may be included. However, it is preferred that they are present in an total amount of from 0.01% by weight to 5% by weight, preferably 0.05% by weight to 3% by weight, more preferably 0.1% by weight to 2.5% by weight, such as 0.2% by weight to 2% by weight based on the total weight.

Additional Surfactants

The detergent compositions may include further surfactants. The surfactant may also be included in the detergent composition and any of nonionic, anionic, cationic, amphoteric or zwitterionic surface active agents or suitable mixtures thereof may be used. Many such suitable surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred according to the present invention.

Non-ionic surfactants are especially preferred according to the present invention, especially for automatic dishwashing compositions. For laundry and cleaning applications (excluding automatic dishwashing) other surfactants such as anionic surfactants are preferably included and suitable types are well known in the art.

A preferred class of nonionic surfactants is ethoxylated non-ionic surfactants prepared by the reaction of a mono-hydroxy alkanol or alkylphenol with 6 to 20 carbon atoms.

Preferably the surfactants have at least 12 moles particularly preferred at least 16 moles, and still more preferred at least 20 moles, such as at least 25 moles of ethylene oxide per mole of alcohol or alkylphenol.

Particularly preferred non-ionic surfactants are the non-ionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the additional non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30% by weight, preferably more than 50% by weight, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_X[CH_2CH_2O]_Y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3$ H, methyl or ethyl is particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention for instance mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the shaped body or the detergent composition in an amount of from 0.1% by weight to 20% by weight, more preferably 1% by weight to 15% by weight, such as 2% to 10% by weight based on the total weight of the detergent composition.

Enzymes

The detergent compositions may also include enzymes. It is preferred that the enzyme is selected from proteases, lipases, amylases, cellulases and peroxidases, with proteases and amylases, especially proteases being most preferred. It is most preferred that protease and/or amylase enzymes are included in the compositions according to the invention as such enzymes are especially effective for example in dishwashing detergent compositions. Any suitable species of these enzymes may be used as desired. More than one species may be used.

Bleach Activators

The detergent compositions may also comprise bleach additives or bleach activation catalysts. The composition may preferably comprise one or more bleach activators or bleach catalysts depending upon the nature of the bleaching compound. Any suitable bleach activator may be included for example TAED if this is desired for the activation of the bleach material. Any suitable bleach catalyst may be used for example manganese acetate or dinuclear manganese complexes such as those described in EP-A-1,741,774.

The organic peracids such as perbenzoic acid and peroxycarboxylic acids e.g. PAP do not require the use of a bleach activator or catalyst as these bleaches are active at relatively low temperatures such as about 30° C. and this contributes to such bleach materials being especially preferred according to the present invention.

Water may be included in the detergent composition.

Performance Polymers

Polymers intended to improve the cleaning performance of the detergent compositions may also be included therein. For example sulphonated polymers may be used. Preferred examples include copolymers of the formula:

$$CH_2{=}CR^1{-}CR^2R^3{-}O{-}C_4H_3R^4{-}SO_3X$$

wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allysulphonic acid, methallysulphonic acid, 2-hydroxy-3-(2-propenyloxy)propanesulphonic acid, 2-methyl-2-propenen-1-sulphonic acid, styrenesulphonic acid, vinylsulphonic acid, 3-sulphopropyl acrylate, 3-sulphomethylacrylamide, sulphomethylmethacrylamide and water soluble salts thereof. Suitable sulphonated polymers are also described in U.S. Pat. No. 5,308,532 and in WO 2005/090541.

When a sulfonated polymer is present, it is preferably present in an amount of at least 0.1% by weight, preferably at least 0.5% by weight, more preferably at least 1% by weight, and most preferably at least 3% by weight, up to 40% by weight, preferably up to 25% by weight, more preferably up to 15% by weight, and most preferably up to 10% by weight.

Additional Components

The detergent composition may also comprise one or more foam control agents. Suitable foam control agents for this purpose are all those conventionally used in this field, such as, for example, silicones and their derivatives and paraffin oil. The foam control agents are preferably present in amounts of 0.5% by weight or less.

The detergent compositions may also comprise minor, conventional, amounts of preservatives.

Water may be included in the detergent composition.

EXAMPLES

The invention is further described, by way of illustration only, with reference to the following non-limiting Examples.

Drying Performance Testing

The following compositions were tested. All were formulated into 20.8 gram tablets.

Composition A represents a control formulation. Formulations B-E represent non-limiting compositions according to the present invention.

Compositions for testing (weight %)

| Ingredients | A | B | C | D | E |
|---|---|---|---|---|---|
| Non-ionic surfactant Dehypon E 127 ™ | 0 | 6 | 4 | 6 | 4 |
| Nonionic surfactant Dehypon GRA ™ | 0 | 0 | 2 | 0 | 2 |

-continued

| Compositions for testing (weight %) | | | | | |
|---|---|---|---|---|---|
| Ingredients | A | B | C | D | E |
| Non-ionic surfactant Lutensol AT 25 ™ | 6 | 0 | 0 | 0 | 0 |
| Amphoteric polymer Mirapol Surf S ™ | 0 | 0 | 0 | 0.25 | 0.25 |
| Anionic Polymer | 6 | 6 | 6 | 6 | 6 |
| Sodium Percarbonate | 10.5 | 10.5 | 10.5 | 10.5 | 10.5 |
| TAED | 3 | 3 | 3 | 3 | 3 |
| Sodium carbonate | 15 | 15 | 15 | 15 | 15 |
| Protease | 2 | 2 | 2 | 2 | 2 |
| Amylase | 1 | 1 | 1 | 1 | 1 |
| STPP | 47 | 47 | 47 | 47 | 47 |
| Phosphonate | 1 | 1 | 1 | 1 | 1 |
| Water | 12.5 | 8.5 | 8.5 | 8.5 | 8.5 |

For this purpose a machine load consisting of china, glass, plastic and stainless steel was, after adding a defined amount of soil into a dishwasher (Bosch SGS058M02EU/36; Eco 50° with deactivated automatic detergent detecting adjustment of the rinse program [=with deactivated "auto 3 in 1 function"]) was cleaned with 20.8 g of the ADW detergents listed in the table below at 21° dH. The dosing was done in the main wash cycle.

The drying index was determined 30 minutes after the end of the complete dishwashing program. The door of the dishwasher was kept closed during these 30 minutes.

The maximum score for ideal drying is 0, the worst score is 6. The reported value represents the average of three trials.

| Drying performance | | | | | |
|---|---|---|---|---|---|
| Surface | A | B | C | D | E |
| China | 1.76 | 0.07 | 0.21 | 0.16 | 0.43 |
| Glass | 1.19 | 0.03 | 0.08 | 0.14 | 0.08 |
| Plastic | 5.97 | 0.31 | 0.47 | 0.19 | 0.42 |
| Stainless Steel | 0.83 | 0.28 | 0.33 | 0.32 | 0.49 |

The compositions of the invention (B-D) clearly demonstrate superior drying performance over the control composition (A). Drying performance is improved on all surfaces.

The Rinse Performance was determined in an extra test with the same test conditions as used for drying performance.

The load was evaluated for spotting and filming. Scale is from 1 to 10, wherein 10 is the best score.

| Rinse performance [spotting] | | | | | |
|---|---|---|---|---|---|
| Surface | A | B | C | D | E |
| Long drink glasses | 5.6 | 3.9 | 3.1 | 4.7 | 4.5 |
| Whiskey glasses | 6.1 | 3.7 | 3.0 | 5.2 | 5.3 |
| Ventura knives | 5.4 | 5.6 | 5.8 | 5.6 | 5.8 |
| Porcelain plates | 6.0 | 5.6 | 5.1 | 6.0 | 6.1 |
| Melamine plastic plates | 3.5 | 4.0 | 5.2 | 4.1 | 3.8 |
| PP Bowl | 3.0 | 4.0 | 3.8 | 3.8 | 4.0 |

| Rinse performance [filming] | | | | | |
|---|---|---|---|---|---|
| Surface | A | B | C | D | E |
| China | 7.0 | 6.9 | 7.0 | 6.2 | 5.8 |
| Glass | 7.9 | 8.0 | 7.0 | 6.3 | 5.8 |

-continued

| Rinse performance [filming] | | | | | |
|---|---|---|---|---|---|
| Surface | A | B | C | D | E |
| Plastic | 7.9 | 7.9 | 7.9 | 7.9 | 7.9 |
| Stainless Steel | 7.9 | 8.0 | 8.0 | 8.0 | 7.7 |
| Melamine plastic plates | 7.6 | 7.7 | 7.8 | 7.8 | 7.8 |
| PP Bowl | 8.0 | 8.0 | 8.7 | 8.7 | 8.0 |

It can be seen from the rinsing tables that the compositions of the present invention (B-E) offer a similar rinsing performance to that of the control formulation A. Thus the compositions of the present invention provide superior drying performance while maintaining rinsing performance.

While several possible embodiments are disclosed above, embodiments of the present invention are not so limited. For instance, while several possible detergent compositions, and methods for forming and/or using said dosage element for use in ware washing machines have been disclosed, other suitable materials and combinations of materials, as well as steps in methods of forming and/or using the element, could be selected without departing from the spirit of embodiments of the invention. Such changes are intended to be embraced within the scope of the invention.

The specific configurations, choice of materials, and the size and shape of various elements can be varied according to particular design specifications or constraints requiring a device, system, or method constructed according to the principles of the invention. The specific steps in methods of making and/or using the dosage elements can also be varied as needed. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A detergent composition comprising a non-ionic surfactant selected from the group consisting of:

(Formula I)

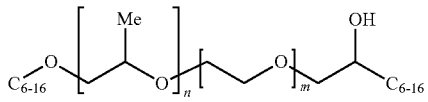

wherein n =0-5 and m =10-50;

and $R^1O(AlkO)xM(OAlk)yOR^2$ (Formula II)

wherein $R^1$ and $R^2$ are independently saturated or unsaturated, and possibly hydroxylated, alkyl radicals with 4 to 22 carbon atoms;

wherein Alk is an alkyl radical with 2 to 4 carbon atoms;

wherein x and y are independently an integer between 1 and 70; and wherein M is an alkyl radical selected from the group consisting of $CH_2$, $CHR^3$, $CR^3R^4$, $CH_2CHR^3$, $CHR^3CHR^4$, wherein $R^3$ and $R^4$ are independently saturated or unsaturated alkyl radicals with 1 to 18 carbon atoms; and wherein the detergent composition is an automatic dishwashing detergent composition;

wherein the detergent composition comprises a homopolymer of acrylic acid; and wherein the detergent composition comprises at least two different non-ionic surfactants according to the formulae.

2. The detergent composition according to claim 1, wherein each of the non-ionic surfactants is present in the composition between 0.5 and 20% by weight.

3. The detergent composition according to claim 1 further comprising an amphoteric polymer.

4. The detergent composition according to claim 3, wherein the amphoteric polymer comprises a quaternized ammonium acrylamide/acylic acid copolymer.

5. The detergent composition according to claim 3, wherein the amphoteric polymer comprises:

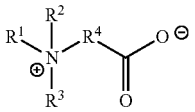

wherein $R^1$ is an alkyl group having 10 to 20 carbon atoms;

wherein $R^2$ and $R^3$ are each alkyl groups having 1 to 3 carbons; and wherein $R^4$ is an alkylene or hydroxyalkylene group having 1 to 4 carbon atoms.

6. The detergent composition according to claim 3, wherein the amphoteric polymer comprises a diallyl dimethyl ammonium acrylamide/acrylic acid copolymer.

7. The detergent composition according to claim 5, wherein $R^1$ of the amphoteric polymer is an alkyl group having 12 to 16 carbon atoms.

8. The detergent composition according to claim 5, wherein $R^1$ of the amphoteric polymer is the amido radical

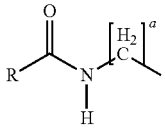

wherein R is an alkyl group having 9 to 19 carbon atoms and a is an integer between 1 and 4.

9. The detergent composition according to claim 5, wherein $R^2$ and $R^3$ have 1 carbon.

10. The detergent composition according to claim 5, wherein $R^4$ further has one hydroxyl group.

11. A method of automatic dishwashing comprising:

supplying the composition of claim 1 to an automatic dishwasher; and operating the automatic dishwasher.

* * * * *